US008228248B1

(12) United States Patent
Kahle et al.

(10) Patent No.: US 8,228,248 B1
(45) Date of Patent: Jul. 24, 2012

(54) DORSAL HIGH FREQUENCY ANTENNA

(75) Inventors: William P. Kahle, Seattle, WA (US); Brian P. Stapleton, Seattle, WA (US); Diane Woltz, Bellevue, WA (US); Ronald R. Hess, Renton, WA (US); Todd C. Baldwin, Lake Forest Park, WA (US); Takeo Kuraishi, Kirkland, WA (US)

(73) Assignee: The Boeing Company, Chicago, IL (US)

( * ) Notice: Subject to any disclaimer, the term of this patent is extended or adjusted under 35 U.S.C. 154(b) by 242 days.

(21) Appl. No.: 12/692,721

(22) Filed: Jan. 25, 2010

(51) Int. Cl.
*H01Q 1/28* (2006.01)

(52) U.S. Cl. ..... 343/705; 343/708

(58) Field of Classification Search ..... 343/705, 343/708

See application file for complete search history.

(56) References Cited

U.S. PATENT DOCUMENTS 6,023,919 A * 2/2000 Deckert et al. ..... 54/37.1
6,266,582 B1 * 7/2001 Bruckner ..... 701/4
7,053,845 B1 * 5/2006 Holloway et al. ..... 343/725
2005/0083238 A1 * 4/2005 Kennedy et al. ..... 343/767
2008/0169987 A1 7/2008 McNutt

* cited by examiner

*Primary Examiner* — Hoanganh Le

(74) *Attorney, Agent, or Firm* — Toler Law Group

(57) ABSTRACT

An aircraft antenna, an antenna system, and a method of providing an antenna are disclosed. A conductive plate is configured to conform to an area on an outer surface of a fuselage of an aircraft. The conductive plate is configured to be positioned in direct and intimate contact with a conductive portion of the fuselage. A conductive rib is configured to be electrically coupled to the conductive plate and to extend toward a first point adjacent an inner surface of a structure of the aircraft that extends from the fuselage. A conductive spine configured to extend along the inner surface of the structure between the first point and a second point. The conductive spine is electrically coupled to the conductive rib at the first point and is configured to receive a conductive feed line at the second point. An antenna coupler mount is configured to receive an antenna coupler. The antenna coupler mount is physically coupled to a surface of the conductive plate and is electrically coupled to the conductive plate.

20 Claims, 6 Drawing Sheets

DORSAL HIGH FREQUENCY ANTENNA

FIELD OF THE DISCLOSURE

The present disclosure is generally related to an antenna for an aircraft.

BACKGROUND

It is desirable to reduce consumption of fuel to serve environmental and economic goals. To this end, manufacturers of fuel-consuming vehicles strive to produce lighter vehicles that consume less fuel. For example, a next generation of aircraft is being produced that uses a lighter weight composite fuselage instead of a traditional metal fuselage. For example, the composite fuselage may include an inter-woven wire fiber covered by a carbon-reinforced plastic that is significantly lighter than a metal fuselage having the same size and structural strength.

In addition to producing a lighter weight fuselage, manufacturers also seek to reduce the weight of other aspects of the aircraft by reducing the weight of mechanical and electrical components while providing the same functionality as heavier components that are being replaced. Moreover, many of these systems, ranging from hangers used to mount devices to the composite fuselage to components of the electrical systems, also are designed to be compatible with the composite fuselage.

On an aircraft with a metal fuselage, an antenna may be electrically coupled to the outer surface of the fuselage to make use of the extensive, existing conductive surfaces of the fuselage. In an aircraft with a composite fuselage without a conductive outer surface, coupling, however, the antenna cannot simply be electrically coupled to the outer surface. Conductive foils or other conductive panels may be added to the structure of the aircraft to provide a conductive surface for an antenna to use, but adding such conductive materials adds to the weight of the aircraft and, thus, detracts from some of the weight savings gained by using a composite fuselage. There is therefore a need to provide a lightweight high frequency antenna system to enable high frequency communications that is compatible with a composite fuselage.

SUMMARY

Embodiments disclosed herein are directed to aircraft antennas, antenna systems, and methods of providing an aircraft antenna, where the antenna is configured to radiate in a high frequency range. In one embodiment, the antenna may be mounted within a structure of the aircraft that extends from the fuselage, such as within a vertical stabilizer, a horizontal stabilizer, or a wing of the aircraft. A conductive plate may be configured to conform to an area on an outer surface of the fuselage of the aircraft. The conductive plate is electrically coupled to a conductive portion of the fuselage, such as an inter-woven wire fiber or expanded mesh extending through the fuselage. A conductive rib may be electrically coupled to the conductive plate and may extend from the conductive plate toward an inner surface of the vertical stabilizer, horizontal stabilizer, wing, or other structure extending from the fuselage of the aircraft. A conductive spine extends along the inner surface of the structure between a first point and a second point. The conductive spine is electrically coupled to the conductive rib at the first point and the conductive spine is electrically coupled to a conductive feed line of a transceiver at the second point. An antenna coupler mount receives an antenna coupler. The antenna coupler mount is physically and electrically coupled to a surface of the conductive plate and mechanically and electrically connects the antenna coupler to the conductive portion of the fuselage via the conductive plate. Thus, the antenna is coupled to conductive portions of the fuselage to enable high frequency communication.

In a particular illustrative embodiment, an antenna is disclosed. A conductive plate is configured to conform to an area on an outer surface of a fuselage of an aircraft. The conductive plate is configured to be positioned in direct and intimate contact with a conductive portion of the fuselage. A conductive rib is configured to be electrically coupled to the conductive plate and to extend toward a first point adjacent an inner surface of a structure of the aircraft that extends from the fuselage. A conductive spine is configured to extend along the inner surface of the structure between the first point and a second point. The conductive spine is electrically coupled to the conductive rib at the first point and is configured to receive a conductive feed line at the second point. An antenna coupler mount is configured to receive an antenna coupler. The antenna coupler mount is physically coupled to a surface of the conductive plate and is electrically coupled to the conductive plate.

In another particular illustrative embodiment, an antenna system is disclosed for an aircraft having a composite fuselage. The composite fuselage includes a conductive portion that is at least largely covered by at least one of a non-conductive or largely non-conductive material. The system includes a high frequency antenna coupler configured to exchange signals with a high frequency transceiver. A conductive plate is curved to conform to a shape of an area on the outer surface of the fuselage of the aircraft. The conductive plate is configured to be positioned in direct and intimate contact with an exposed area of the conductive portion of the fuselage. An antenna coupler is configured to exchange signals with the high frequency transceiver. An antenna coupler mount has a first surface to conform to the conductive plate and a second surface configured to receive the antenna coupler. A conductive rib is configured to be electrically coupled to the conductive plate and to extend toward a first point adjacent an inner surface of a structure of the aircraft extending from the fuselage. A conductive spine is configured to extend along the inner surface of the structure of the aircraft between the first point and a second point. The conductive spine is electrically coupled to the conductive rib at the first point and is electrically coupled to the antenna coupler at the second point.

In still another particular illustrative embodiment, a method of providing an aircraft antenna on an aircraft having a composite fuselage is disclosed. The method includes exposing an area of conductive material of a composite fuselage of the aircraft. A conductive layer is positioned in direct and intimate contact with the area of conductive material. An antenna coupler mount is joined to the conductive layer and to the fuselage with conductive connectors. The antenna coupler mount is electrically coupled to the conductive layer and to the conductive material of the composite fuselage. An antenna coupler is mounted to the antenna coupler mount. A conductive spine is positioned to extend away from the composite fuselage where the conductive spine will extend along an inner surface of a structure extending away from the composite fuselage. A first end of the conductive spine is electrically coupled to the conductive layer. A second end of the conductive spine is electrically coupled to the antenna coupler.

The aircraft antenna and the antenna system provided, such as by use of the disclosed method, are relatively light in weight. In addition, the aircraft antenna and the antenna system are compatible with a composite aircraft fuselage to enable high frequency communications.

The features, functions, and advantages that have been described can be achieved independently in various embodiments or may be combined in yet other embodiments, further details of which are disclosed with reference to the following description and drawings.

DETAILED DESCRIPTION

Particular illustrative embodiments of an aircraft antenna, an antenna system, and a method of providing an antenna are disclosed. Embodiments of the antenna system are suited for use with an aircraft using a composite fuselage. The antenna system is positioned within a structure extending from the fuselage, such as within a vertical stabilizer of the aircraft. In this particular illustrative embodiment, a conductive plate is secured to an exposed, conductive portion of the fuselage beneath the vertical stabilizer. A conductive rib and an antenna coupler mount are mechanically and electrically joined to the conductive plate. The conductive rib extends toward an inner surface of the vertical stabilizer where it supports a conductive spine. The conductive spine extends along the inner surface of the vertical stabilizer. The conductive spine is potentially supported by one or more non-conductive ribs or the one or more non-conductive ribs may support the inner surface of the vertical stabilizer and the conductive spine may be supported by the inner surface of the vertical stabilizer. The conductive spine is coupled by one or more feed lines to an antenna coupler received in the antenna coupler mount. The antenna thus is electrically coupled to the conductive portion of the fuselage. The antenna is also disposed within the structure of the vertical stabilizer where the antenna is protected from contact or weather damage and avoids adding additional drag to the aircraft.

Figures 1, 2:
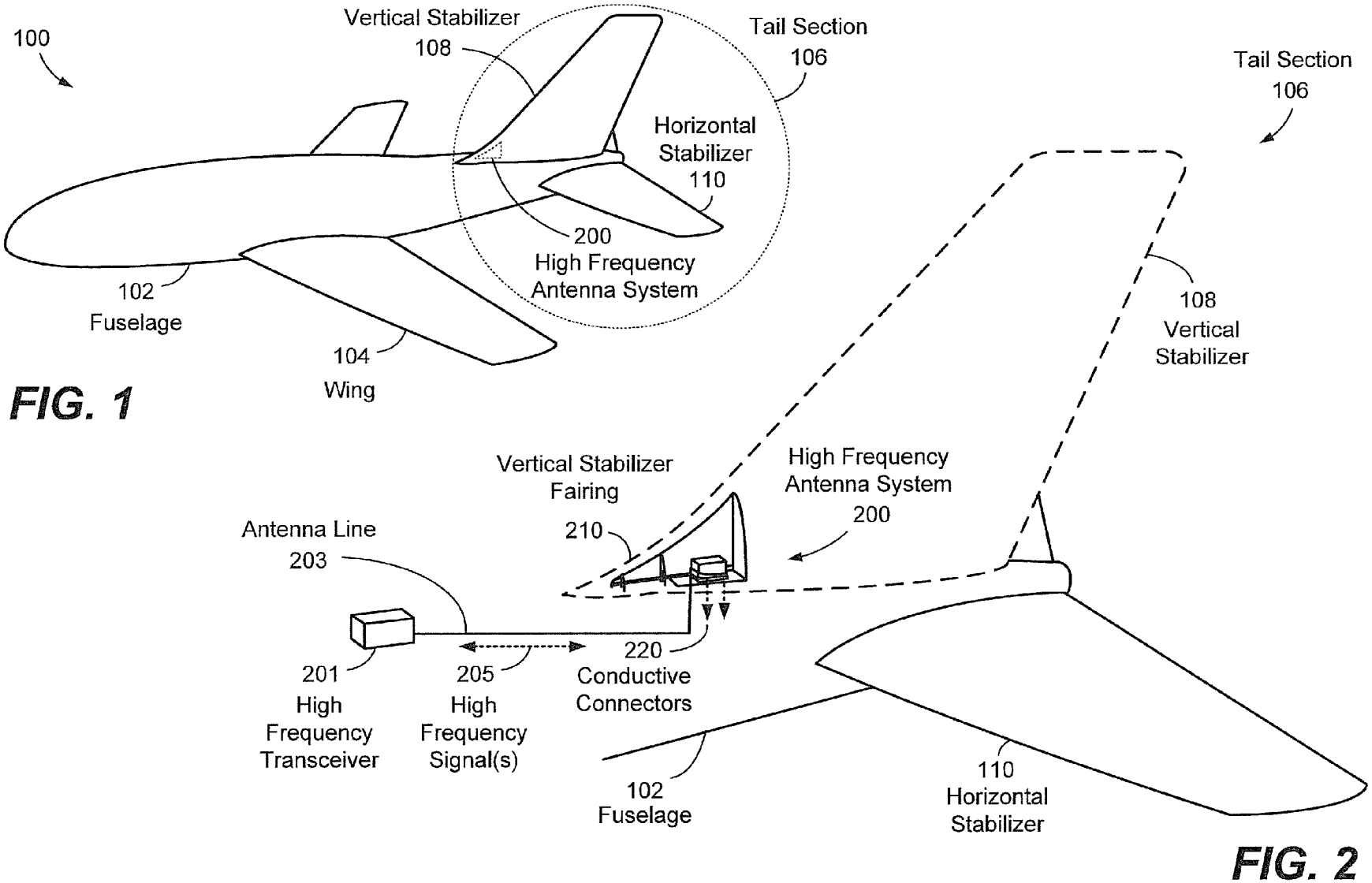
FIG. 1 is a perspective diagram of an aircraft including a particular illustrative embodiment of an antenna system within a vertical stabilizer of the aircraft.
FIG. 2 is a cutaway diagram of the vertical stabilizer of FIG. 1 showing the high frequency antenna system joined to a fuselage of the aircraft.

FIG. 1 is a perspective diagram of an aircraft 100 including a particular illustrative embodiment of an antenna system 200 within a vertical stabilizer 108 of the aircraft 100. The aircraft 100 includes a fuselage 102 and a number of structures extending from the fuselage 102, including wings 104 a tail section 106, the vertical stabilizer 108 and a horizontal stabilizer 110. The fuselage 102 may include a composite structure including a conductive portion that is at least largely covered by at least one of a non-conductive material or a largely non-conductive material. For example, the conductive portion of the composite structure may include an inter-woven wire fabric or expanded mesh. The conductive portion may be covered by a largely non-conductive material such as a carbon fiber reinforced plastic. The non-conductive or largely non-conductive material causes at least a majority of the exterior of the fuselage to be non-conductive. The carbon fiber reinforced plastic may be covered by a surfacer. The surfacer may be used to enhance the outer appearance of the fuselage or for other uses. The surfacer may include, for example, a paint primer sprayed over the fuselage 102, a pinhole filler sprayed over the fuselage 102, a resin sheet applied at the time the fuselage 102 is cured, or a fiber-reinforced, thin-film veil mat applied over the surface of the fuselage 102. Application of the surfacer results in paint applied to the outer surface of the fuselage 102 having a better appearance.

In a particular illustrative embodiment, the antenna system 200 is positioned in the vertical stabilizer 108. By positioning the antenna system 200 in the vertical stabilizer 108 or in one of the other structures extending from the fuselage 102, such as the wing 104 or the horizontal stabilizer 110, the antenna system 200 is protected from contact damage and weather damage. By positioning the antenna system 200 in the vertical stabilizer 108 or in one of the other structures extending from the fuselage 102, the antenna system 200 does not need to have the structural rigidity sufficient to withstand the stresses caused by exposure to an external environment during flight nor does the antenna 200 present another surface that may add additional drag to the aircraft 100.

FIG. 2 is a cutaway diagram of the vertical stabilizer 108 of FIG. 1 showing the antenna system 200 joined to a fuselage 102 of the aircraft 100. In a particular illustrative embodiment, the antenna system 200 is positioned inside a vertical stabilizer fairing 210 at a front edge of the vertical stabilizer 108. The antenna system 200 is structurally mounted to the fuselage 102 and is electrically coupled to the fuselage 102 using one or more conductive connectors 220 described in more detail below. The antenna system 200 is electrically coupled to a high frequency transceiver 201 via an antenna line 203 that carries high frequency signals 205 between the high frequency antenna system 200 and the high frequency transceiver 201. The transceiver 201 may be located in a cockpit, equipment bay, or other location within the fuselage 102 or another structure of the aircraft. The high frequency transceiver 201 generates and processes signals in a high frequency range between 2 megahertz and 30 megahertz. The high frequency transceiver 201 exchanges the signals in the high frequency range with the antenna system 200. The antenna system 200 may include an antenna coupler to exchange the signals with the high frequency transceiver 201.

Figure 3:
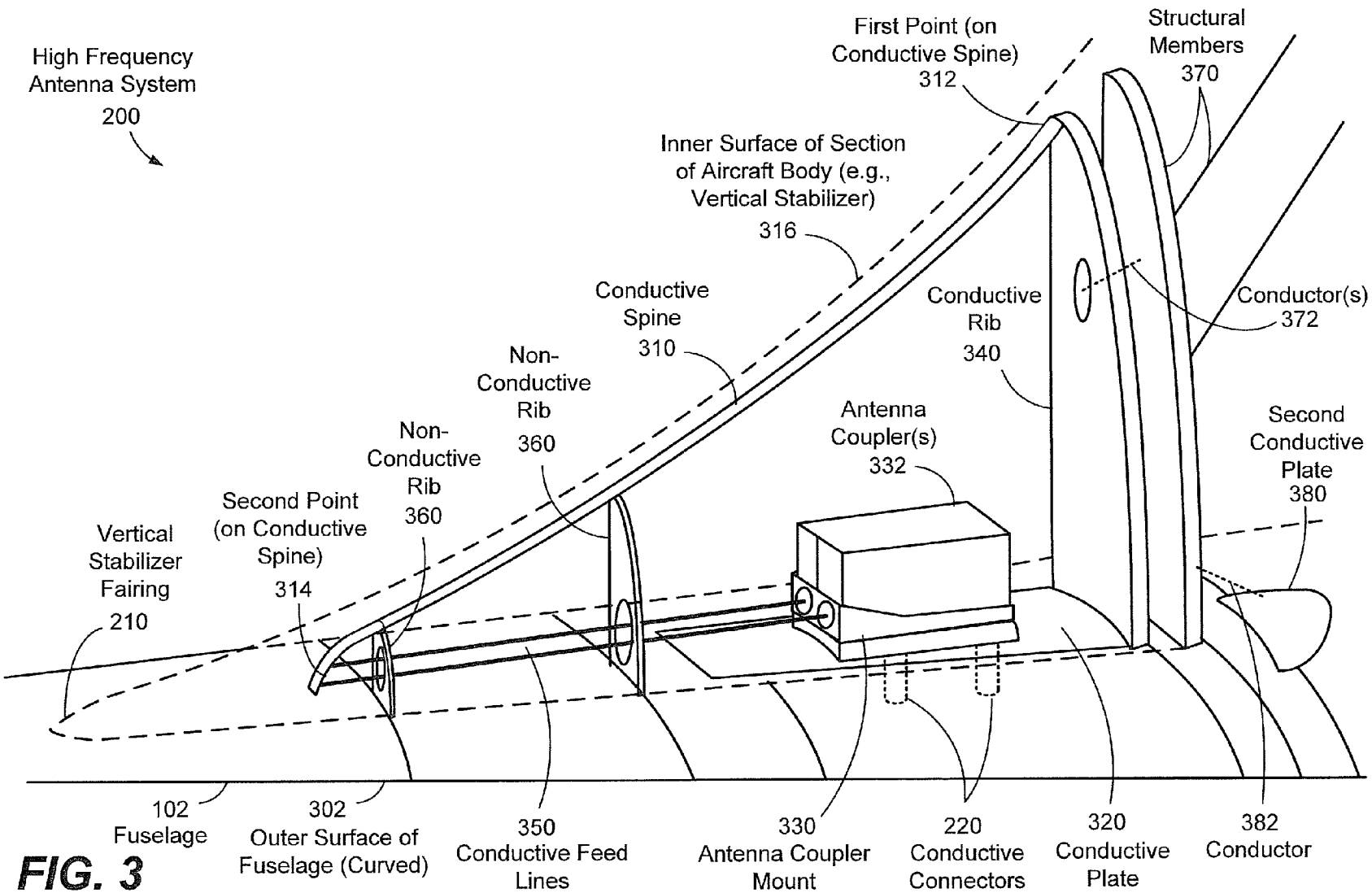
FIG. 3 is a perspective diagram of a particular illustrative embodiment of the high frequency antenna system of FIG. 2.

FIG. 3 is a perspective diagram of a particular illustrative embodiment of the high frequency antenna system 200 of FIG. 2. The high frequency antenna system 200 is positioned on an outer, curved surface 302 of the fuselage 102 within the vertical stabilizer fairing 210. The high frequency antenna system 200 includes a conductive spine 310, a conductive plate 320, an antenna coupler mount 330, an antenna coupler 332, and one or more conductive feed lines 350. The high frequency antenna system 200 may include a plurality of conductive connectors 220. The high frequency antenna system 200 also may include one or more optional conductors 372 to electrically couple the high frequency antenna to structural members 370 that mechanically support the vertical stabilizer 108, vertical stabilizer fairing 210, or other structure extending from the fuselage 102 in which the high frequency antenna system 200 is positioned. The high frequency antenna system 200 also may include one or more other optional conductors 382 or to couple the structural members 370 to a second conductive plate 380 electrically coupled to the conductive portion of the fuselage 102.

In one particular illustrative embodiment, the conductive plate 320 is affixed in direct and intimate contact with the conductive portion of the fuselage 102. As described with reference to FIGS. 6A-6C, one or more exterior layers of the fuselage 102 may be removed in order to expose the conductive portion of the fuselage 102 in a mounting area beneath the conductive plate 320. The conductive plate 320 may be curved or otherwise formed to conform to the curved surface 302 of the fuselage 102. An antenna coupler mount 330 is secured to the conductive plate 320. As further described with reference to FIG. 4, because the conductive plate 320 may have a curved surface and the antenna coupler 332 may have a flat bottom surface, the antenna coupler mount 330 may provide an adapter between the curved surface of the conductive plate 320 and the flat bottom surface of the antenna coupler 332. The antenna coupler 332 may be electrically and mechanically coupled to the antenna coupler mount 330 using conductive fasteners (not shown).

A conductive rib 340 is electrically coupled to the conductive plate 320 and extends toward an inner surface 316 of a structure extending from the fuselage 102 of an aircraft in which the high frequency antenna system 200 is positioned. In the particular illustrative embodiment of FIG. 3, the structure of the aircraft body in which the high frequency antenna system 200 is positioned is the vertical stabilizer fairing 210 of the vertical stabilizer 108 of FIGS. 1 and 2. Thus, the conductive rib 340 extends from the conductive plate 320, positioned against the fuselage 102, toward the inner surface of the vertical stabilizer 316. At a first point 312 on a conductive spine 310, the conductive spine 310 is mechanically and electrically coupled to the conductive rib 340. The conductive spine 310 extends along the inner surface 316 of the vertical stabilizer 316, where the conductive spine 310 may be supported above the fuselage 102 by one or more non-conductive ribs 360. Alternatively, the one or more non-conductive ribs 360 may support the inner surface 316 of the vertical stabilizer or the vertical stabilizer fairing 210. The conductive spine 310 may then be supported by the inner surface 316 rather than directly by the one or more non-conductive ribs 360. At a second point 314 on the conductive spine 310, the conductive spine 310 is electrically coupled by one or more conductive feed lines 350 to one or more antenna couplers 332. More than one conductive feed line 350 and antenna coupler 332 may be used to provide redundancy in electrically connecting the high frequency transceiver 201 (FIG. 2) to the second point 314 of the conductive spine 310. The conductive spine 310 and the other elements with which it is electrically coupled, such as the conductive plate 320 and the conductive rib 340, radiates high frequency signals.

The high frequency antenna system 200 may be electrically coupled to other conductive elements of the aircraft. For example, the conductor 372 may be used to electrically couple the conductive rib 340 (which is electrically coupled to other conductive portions of the fuselage 102) to structural members 370 within the vertical stabilizer 108. In addition, if a second conductive plate 380 is electrically coupled to conductive portions (not shown in FIG. 3) of the fuselage 102, another conductor 382 may be used to, for example, electrically couple the structural members 370 to the second conductive plate 380.

In a particular illustrative embodiment, the conductive plate 320 may be formed of copper. The conductive connectors 220 may include conducting sleeves 432 (FIG. 4) formed of titanium, copper, or other conductive materials. The antenna coupler mount 330, the conductive rib 340, and the conductive spine 310 may be formed of aluminum. However, conductive components of the high frequency antenna system 200, such as the conductive plate 320, the conductive connectors 220, the antenna coupler mount 330, the conductive rib 340, and the conductive spine 310, may be formed of any conductive material based on price, weight, durability, or other design considerations. Note that, whatever conductive materials are chosen, the conductive materials of adjoining parts should be galvanically compatible to prevent corrosion.

Figure 4:
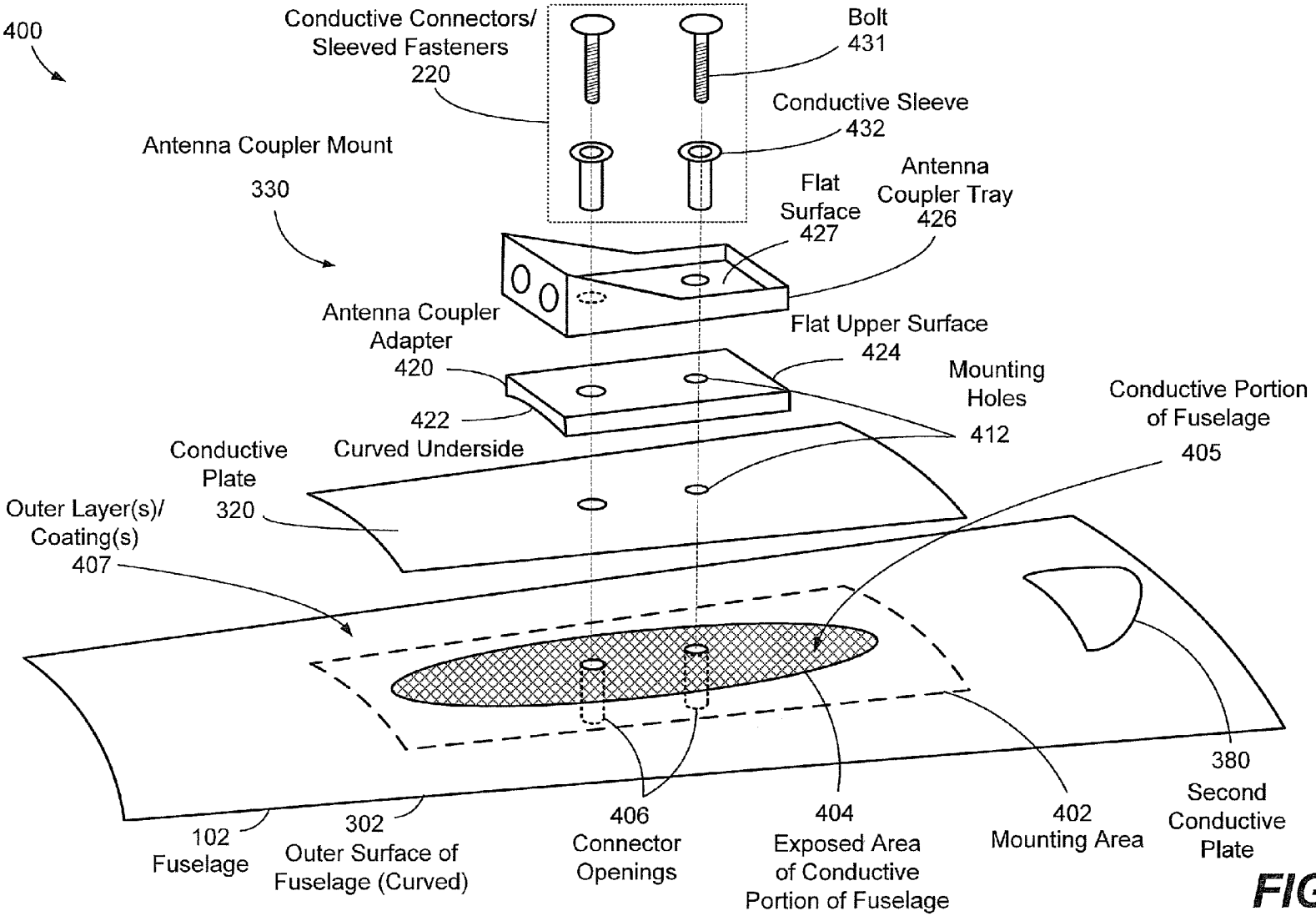
FIG. 4 is an exploded diagram of an antenna coupler mount, a conductive plate, and conductive connectors as they may be secured to the fuselage in a particular illustrative embodiment of the high frequency antenna system of FIG. 3.

FIG. 4 is an exploded diagram 400 of an antenna coupler mount 330, a conductive plate 320, and the conductive connectors 220 as they may be secured to the fuselage 102 in a particular illustrative embodiment of the high frequency antenna system 200 of FIG. 3. As shown in FIG. 4, the antenna coupler mount 330 may include an antenna coupler adapter 420 and an antenna coupler tray 426. The antenna coupler tray 426 may be a conventional, off-the-shelf component that is used to receive a conventional, off-the-shelf antenna coupler 332 (FIG. 3). Because the antenna coupler 332 may have a flat underside, the antenna coupler tray 426 may have a flat surface 427 at is bottom to receive the antenna coupler 332. In order to securely couple the antenna coupler tray 426 to the conductive plate 320, the antenna coupler adapter 420 has a curved underside 422 matching the curvature of the conductive plate 320 (and the curved outer surface of the fuselage 302 to which the conductive plate 320 is joined) and a flat upper surface 424 to securely engage the flat surface 427 of the antenna coupler tray 426. Alternatively, instead of the antenna coupler mount 330 including the antenna coupler adapter 420 and the antenna coupler tray 426, the antenna coupler mount 330 may be formed as a single piece including surfaces appropriate to the antenna coupler and to the curved outer surface 302 of the fuselage 102.

The conductive plate 320 is secured to a mounting area 402 of the curved outer surface 302 of the fuselage 102. A majority of the mounting area 402, e.g., ninety percent (90% or more) to coextend with the conductive plate 320 includes an exposed area 404 of a conductive portion 405 of the fuselage 102. One or more outer layers or coatings 407 of the fuselage 102 that cover and insulate the conductive portions 404 of the fuselage are removed within the mounting area 402, such as described with reference to FIGS. 6A-6C. When the conductive plate 320 is positioned over the exposed area 404 of the conductive portion 405 of the fuselage 102, the conductive plate 320 is electrically coupled to the conductive portions 405 of the fuselage 102 via the exposed area 404 of the conductive portions 405. The antenna coupler adapter 420 and the antenna coupler tray 426 (or a unified antenna coupler mount) of the antenna coupler mount 330 are also mechanically secured to the fuselage 102 and to the conductive plate 320 by the conductive connectors 220. The antenna coupler adapter 420 and the antenna coupler tray 426 are also electrically coupled to the conductive plate 320 and to the conductive portions 405 of the fuselage both by contact with the conductive plate 320 and with the conductive connectors 220. The conductive connectors 220 may include sleeved fasteners that each include a bolt 431 and a conductive sleeve 432 configured to electrically couple together bodies that contact the conductive sleeve 432. The conductive connectors 220 extend through the antenna coupler mount 330 and through the conductive plate 320 into connector openings 406 in the fuselage 102 to mechanically and electrically connect the antenna coupler mount 330 and the conductive plate 320 to the conductive portions 405 of the fuselage 102.

As described with reference to FIG. 3, the conductive plate 320 (or the conductive rib 340, which is electrically coupled to the conductive plate 320) may be electrically coupled to the second conductive plate 380 to enhance the electrical connection between the conductive plate 320 and the conductive portions 404 of the fuselage 102.

Figure 5:
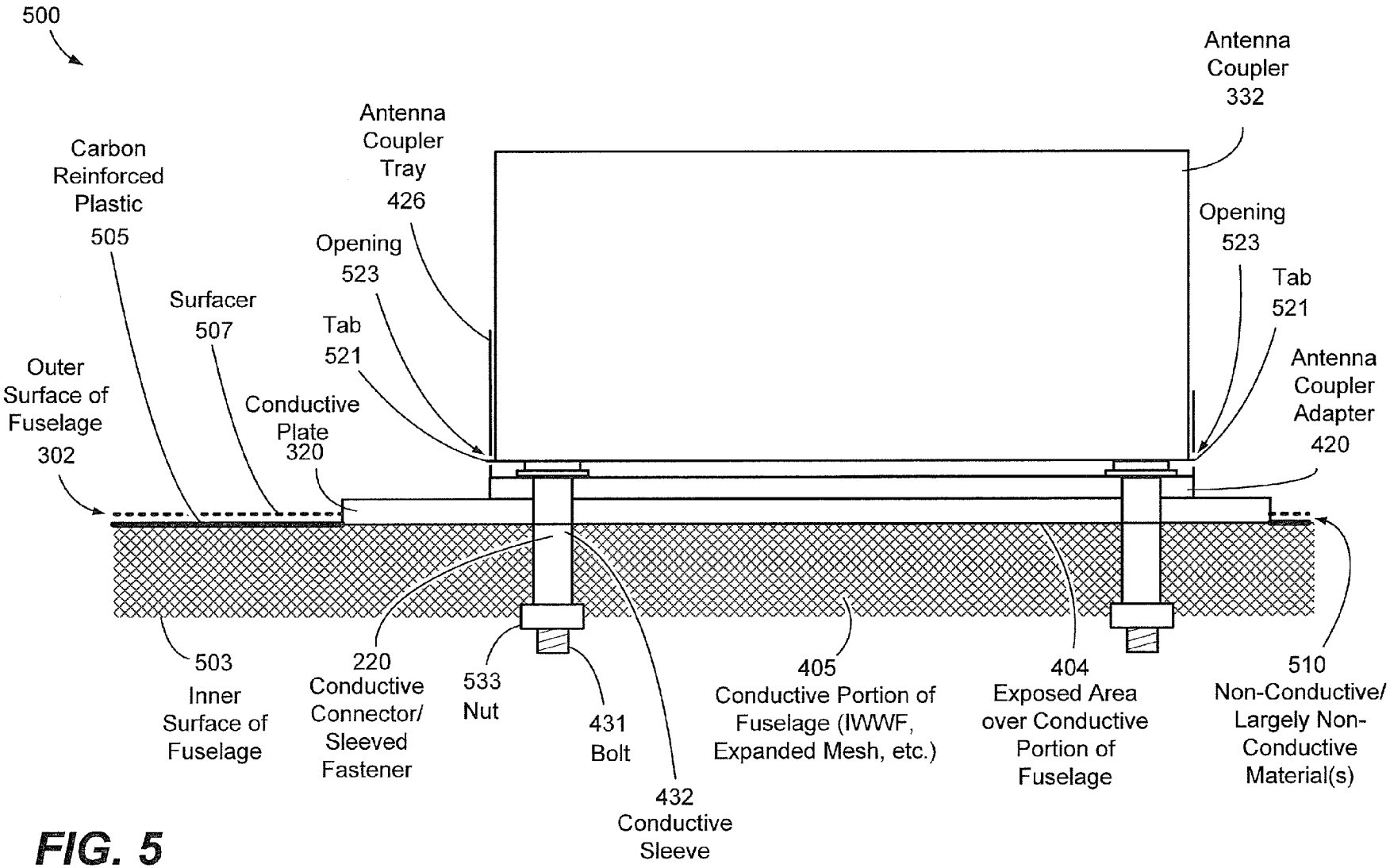
FIG. 5 is a cross-sectional diagram of the antenna coupler mount, the conductive plate, and the conductive connectors as they are secured to the fuselage in a particular illustrative embodiment of the high frequency antenna system of FIG. 3.

FIG. 5 is a cross-sectional diagram 500 of the antenna coupler adapter 420, the antenna coupler tray 426, the conductive plate 320, and the conductive connectors 220 as they are secured to the fuselage 102 in a particular illustrative embodiment of the high frequency antenna system 200 of FIG. 3. As described with reference to FIG. 4, the conductive plate 320 is positioned in direct and intimate contact with the exposed area 404 of the conductive portion 405 of the fuselage 102. FIG. 5 depicts only two layers of the fuselage 102: a layer of one or more non-conductive or largely non-conductive materials 510 largely covering the outer surface 302 of the fuselage 102 and the conductive portion 405 of the fuselage 102. The non-conductive or largely non-conductive materials 510 may include multiple layers, such as a carbon reinforced plastic layer 505 covered by a surfacer 507 as previously described with reference to FIG. 1. The conductive portion 405 of the fuselage 102 also may include multiple layers and the high frequency antenna system 200 may be electrically coupled by the conductive connectors 220 to some or all of the multiple layers that comprise the conductive portions 405 of the fuselage 102.

Specifically, the conductive sleeve 432 of the conductive connector 220 may electrically engage the conductive portion 405 of the fuselage 102. The bolt 431 may also electrically engage the conductive portion 405 of the fuselage 102. The bolt 431 may be mechanically secured to the fuselage 102 by a nut 533. The nut may be positioned within the fuselage 102 so that the nut engages the conductive portion 405 of the fuselage 102. When the nut 533 is formed of a conductive material, the nut 533 may electrically engage the conductive portion 405 of the fuselage 102. The nut 533 may be positioned on an inner surface 503 of the fuselage 102 opposite the outer surface 302 of the fuselage 102. The nut 533 also may be positioned in a recess in the fuselage 102 such that the nut 533 engages the conductive portion 405 of the fuselage 102 as well as the inner surface 503 of the fuselage. The conductive portion 405 of the fuselage 102 may include one or more layers of an inter-woven wire fiber, an expanded mesh, or another type of conductive material. The conductive portion 405 of the fuselage 102 may include a non-conductive material impregnating interstices in the conductive portion 405 without hampering conductive properties of the conductive portion 405.

The antenna coupler tray 426 is positioned on the antenna coupler adapter 420 (when a multiple portion antenna coupler mount 330 is used) and both the antenna coupler tray 426 and the antenna coupler adapter 420 are positioned on the conductive plate 320. The conductive connectors 220 mechanically and electrically connect the antenna coupler tray 426, the antenna coupler adapter 420, and the conductive plate 320 to the conductive portion 405 of the fuselage. The antenna coupler 332 may be coupled to the antenna coupler tray 426 (or a unitary antenna coupler mount 330) by surface contact between the antenna coupler 332 and the antenna coupler tray 426. The antenna coupler 332 may be mechanically secured to the antenna coupler tray by, for example, one or more tabs 521 that are received in corresponding openings 523 in the antenna coupler tray 426 or by other means. Other elements electrically coupled to the conductive plate 320, such as the conductive spine 310 and the conductive rib 340 (FIG. 3) may be electrically coupled to the conductive portion 405 of the fuselage 102 through the electrical connections of the conductive plate 320 to the conductive portion 405 of the fuselage 102.

Figure 6A:
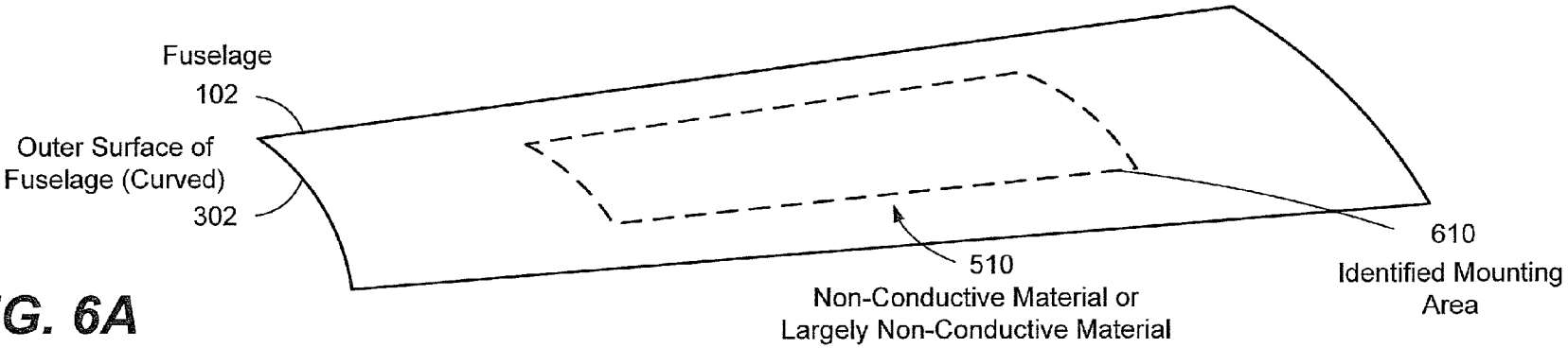
FIGS. 6A-6C are perspective views of a mounting area on the curved outer surface of the fuselage showing a particular illustrative embodiment of exposing a conductive portion of the fuselage to form an exposed area.
Figure 6B:
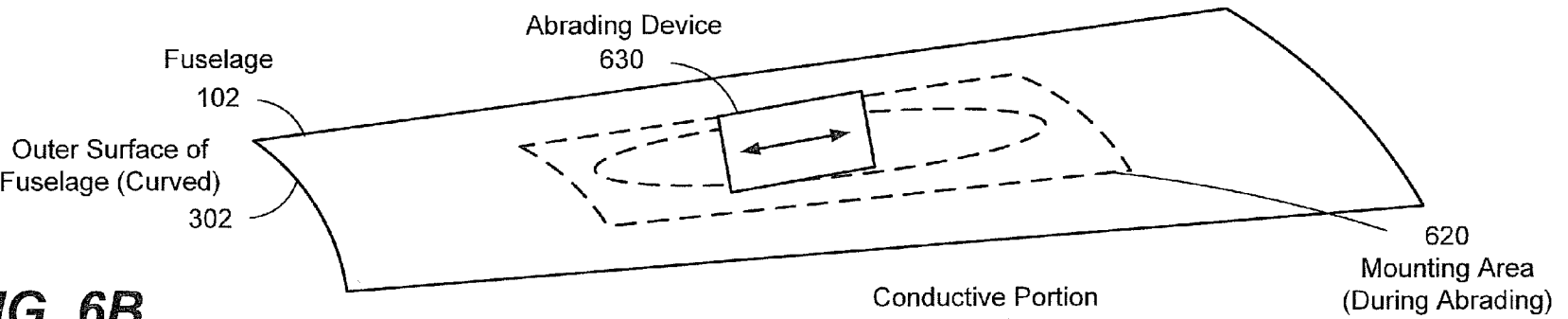
Figure 6C:
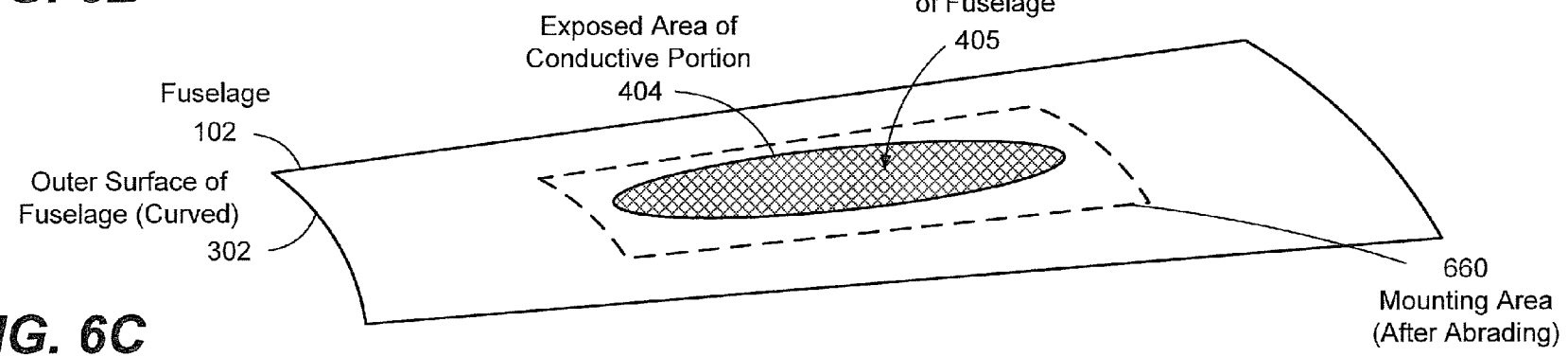

FIGS. 6A-6C are perspective views of a mounting area 610, 620, 660 on the curved outer surface 302 of the fuselage 102 showing a particular illustrative embodiment of exposing a conductive portion of the fuselage to form the exposed area 404. FIG. 6A shows an identified mounting area 610 where the conductive plate 320 shown in FIGS. 3-5 will be positioned. As described with reference to FIGS. 2-3, the high frequency antenna system 200 and, thus, the exposed area 404 may be beneath the vertical stabilizer 108 (FIGS. 1-3) or another structure extending from the fuselage. The identified mounting area may have approximately the same area as the conductive plate 320. FIG. 6B shows the non-conductive material or largely non-conductive material 510 being abraded from at least a portion of a mounting area 620. By moving an abrasive device 630, such as a sanding block holding 60-grit sandpaper, a sanding device supporting suitable sandpaper, powered grinding device, or a similar device, the non-conductive material or largely non-conductive material 510 (e.g., which may include one or more of carbon reinforced plastic 505 and a surfacer 507, as shown in FIG. 5) on the outer surface 302 of the fuselage 102 is abraded. Subsequent cleaning of the mounting area 620 with solvents, such as alcohol, or compressed air may be used to effect removal of the exterior material to fully expose the conductive portion of the fuselage. FIG. 6C shows a suitable mounting area 660 for mounting the conductive plate 320 after abrasion and other similar treatments reveal the exposed area 404 of the conductive portion 405 of the fuselage 102. Alternatively, the exposed area 404 may be formed by masking the exposed area 404 in the manufacturing process of the fuselage 102 or by another process.

Figure 7:
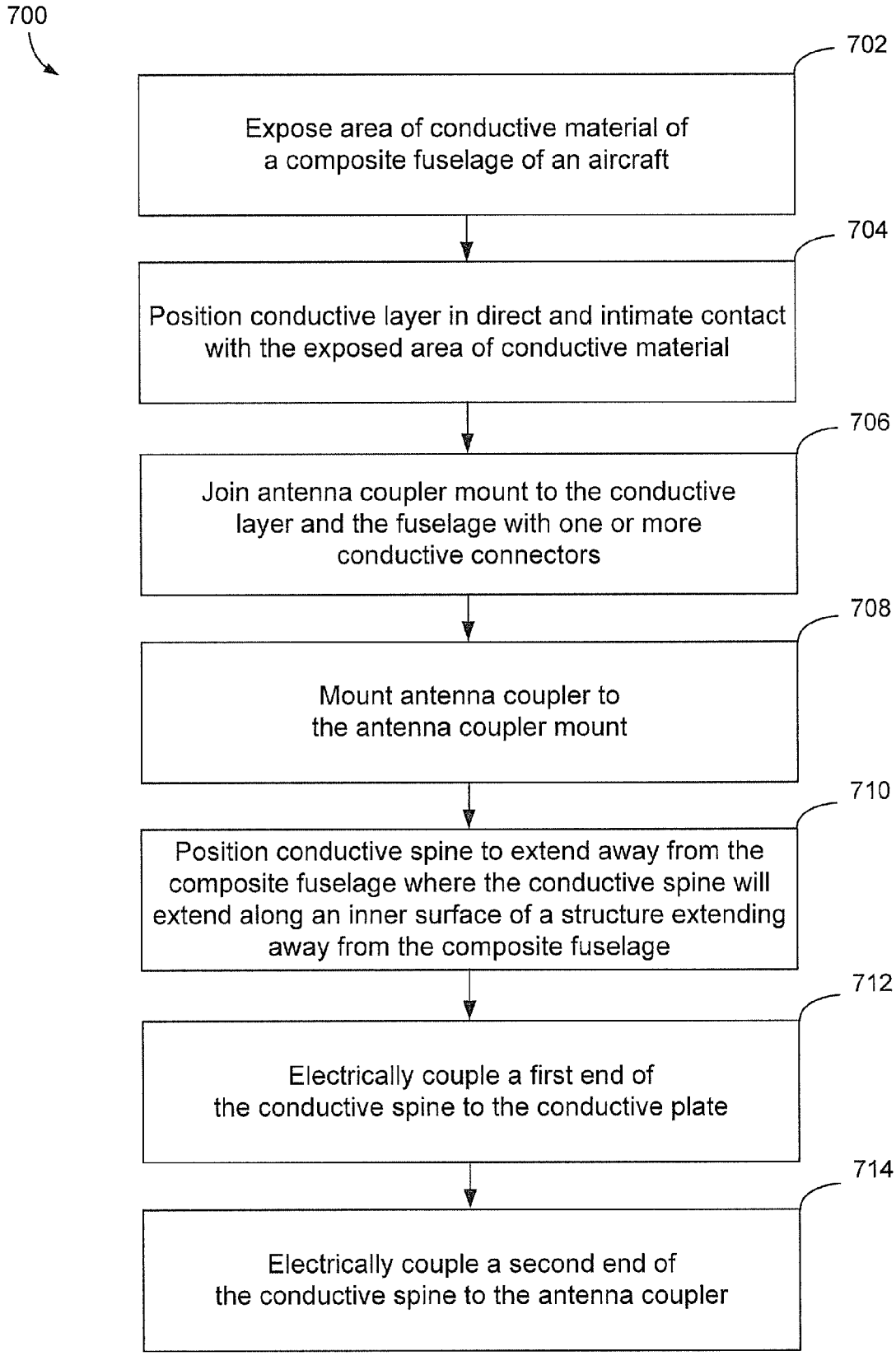
FIG. 7 is a flow diagram of a particular illustrative embodiment of a method of providing an antenna system.

FIG. 7 is a flow diagram of a particular illustrative embodiment of a method 700 of providing an antenna system. An area of conductive material of a composite fuselage of an aircraft is exposed, at 702. Abrading, such as by the use of sand paper may be used to clear an exposed area, such as the exposed area 404 over the conductive portion 405 of the fuselage 102. A conductive layer is positioned in direct and intimate contact with the exposed area of conductive material, at 704. The conductive layer, such as the conductive plate 320, may be curved to closely conform to the exposed area 404 when secured to the fuselage with conductive connectors, as shown in FIG. 4. An antenna coupler mount is joined to the conductive layer and the fuselage with conductive connectors, at 706. For example, the antenna coupler mount 330 (e.g., the antenna coupler adapter 420 and the antenna coupler tray 426 of FIG. 4 may be joined to the conductive plate 320 and to the conductive portion 405 of the fuselage 102 with conductive connectors 220, as shown in FIG. 5. An antenna coupler is connected to the antenna coupler mount, at 708. For example, the antenna coupler 332 may be coupled to the antenna coupler tray 427 by one or more antenna coupler attachment screws 533, as described with reference to FIG. 5.

A conductive spine is positioned to extend away from the composite fuselage where the conductive spine will extend along an inner surface of a structure extending away from the composite fuselage, at 710. For example, the conductive spine 310 may be positioned along the interior surface of the vertical stabilizer 316 as shown in FIG. 3. A first end of the conductive spine is electrically coupled to the conductive layer, at 712. For example, the first end 312 of the conductive spine 310 may be electrically coupled to the conductive rib 340 that is coupled to the conductive plate 320, as shown in FIG. 3. A second end of the conductive spine is electrically coupled to the antenna coupler 332, at 714. For example, the second end 314 of the conductive spine 310 may be coupled by conductive feed lines 350 to the antenna coupler 332, as shown in FIG. 3.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. For example, method steps may be performed in a different order than is shown in the figures or one or more method steps may be omitted. Accordingly, the disclosure and the figures are to be regarded as illustrative rather than restrictive.

Moreover, although specific embodiments have been illustrated and described herein, it should be appreciated that any subsequent arrangement designed to achieve the same or similar results may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, the claimed subject matter may be directed to less than all of the features of any of the disclosed embodiments.

What is claimed is:

1. An aircraft antenna comprising:

a conductive plate configured to conform to an area on an outer surface of a fuselage of an aircraft, wherein the conductive plate is configured to be positioned in direct and intimate contact with a conductive portion of the fuselage;

a conductive rib configured to be electrically coupled to the conductive plate and to extend toward a first point adjacent an inner surface of a structure of the aircraft that extends from the fuselage;

a conductive spine configured to extend along the inner surface of the structure between the first point and a second point, wherein the conductive spine is electrically coupled to the conductive rib at the first point and is configured to receive a conductive feed line at the second point; and an antenna coupler mount configured to receive an antenna coupler, wherein the antenna coupler mount is physically coupled to a surface of the conductive plate and is electrically coupled to the conductive plate.

2. The aircraft antenna of claim 1, wherein the fuselage of the aircraft comprises a composite material and the outer surface of the fuselage is at least largely covered by at least one of a non-conductive material and a largely non-conductive material, wherein the conductive portion of the fuselage is exposed within the area on the outer surface of the fuselage to receive the conductive plate in the direct and intimate contact with the conductive portion of the fuselage.

3. The aircraft antenna of claim 2, wherein the conductive portion of the fuselage includes at least one of:

an inter-woven wire fiber; and an expanded metal mesh.

4. The aircraft antenna of claim 2, wherein the conductive plate is secured to the fuselage using a plurality of conductive connectors configured to extend into a thickness of the fuselage, wherein a conductive sleeve on an exterior surface of each of the conductive connectors is configured to electrically couple the conductive plate to the conductive portion of the fuselage.

5. The aircraft antenna of claim 2, wherein the at least one of the non-conductive material and the largely non-conductive material covering the outer surface of the fuselage includes at least one of a carbon reinforced plastic and a surfacer, wherein the conductive portion of the fuselage is exposed by removing at least one of the non-conductive material and the largely non-conductive material covering the outer surface of the fuselage in the area to receive the conductive plate.

6. The aircraft antenna of claim 2, wherein the conductive rib is configured to be electrically coupled to at least one of:

a structural member that mechanically supports the structure; and a second conductive plate electrically coupled to the conductive portion of the fuselage.

7. The aircraft antenna of claim 1, further comprising a high frequency antenna coupler configured to be received in the antenna coupler mount and to be electrically coupled to the antenna coupler mount, wherein the high frequency antenna coupler is electrically coupled by the conductive feed line to the conductive spine at the second point.

8. The aircraft antenna of claim 7, wherein the high frequency antenna coupler is configured to exchange high frequency signals between 2 megahertz and 30 megahertz with a high frequency transceiver.

9. The aircraft antenna of claim 1, wherein the structure of the aircraft body extending from the fuselage includes one of:

a vertical stabilizer;

a horizontal stabilizer; and a wing.

10. An antenna system for an aircraft having a composite fuselage, wherein the composite fuselage includes a conductive portion at least largely covered by at least one of a non-conductive or largely non-conductive material, the high frequency aircraft antenna system comprising:

a conductive plate, wherein the conductive plate is curved to conform to a shape of an area on an outer surface of the fuselage of the aircraft, wherein the conductive plate is configured to be positioned in direct and intimate contact with an exposed area of the conductive portion of the fuselage;

an antenna coupler, wherein the antenna coupler is configured to exchange signals with a high frequency transceiver;

an antenna coupler mount, wherein the antenna coupler mount has a first surface to conform to the conductive plate and a second surface configured to receive the antenna coupler;

a conductive rib, wherein the conductive rib is configured to be electrically coupled to the conductive plate and to extend toward a first point adjacent an inner surface of a structure of the aircraft extending from the fuselage; and a conductive spine, wherein the conductive spine is configured to extend along the inner surface of the structure of the aircraft between the first point and a second point, wherein the conductive spine is electrically coupled to the conductive rib at the first point, and wherein the conductive spine is configured to be electrically coupled to the antenna coupler at the second point.

11. The high frequency antenna system of claim 10, further comprising a plurality of conductive connectors, wherein each of the plurality of conductive fasteners is configured to extend into a thickness of the fuselage, and wherein a conductive sleeve on an exterior surface of each of the conductive connectors is configured to electrically couple the conductive plate to the conductive portion of the fuselage.

12. The high frequency antenna system of claim 11, wherein the exposed area of the conductive portion of the fuselage includes a portion of at least one of:

an inter-woven wire fiber; and an expanded metal mesh.

13. The high frequency antenna system of claim 12, wherein the exposed area of the conductive portion is exposed by abrading a layer of the at least one of a non-conductive or largely non-conductive material covering the conductive portion of the composite fuselage.

14. The high frequency antenna system of claim 10, wherein the conductive rib is configured to be electrically coupled to a structural member within the structure of the aircraft extending from the fuselage.

15. The high frequency antenna system of claim 10, further comprising one or more support ribs, wherein the support ribs are configured to one of:

support the conductive spine above the fuselage; or support the inner surface of the structure of the aircraft where the conductive spine is supported by the inner surface of the structure.

16. The high frequency antenna system of claim 10, wherein the high frequency signal radiates between 2 megahertz and 30 megahertz.

17. The high frequency antenna system of claim 10, wherein the structure of the aircraft body extending from the fuselage includes one of:

a vertical stabilizer;

a horizontal stabilizer; and a wing.

18. A method of providing an aircraft antenna on an aircraft having a composite fuselage, the method comprising:

exposing an area of conductive material of a composite fuselage of an aircraft;

position a conductive layer in contact with the exposed area of conductive material;

joining an antenna coupler mount to the conductive layer and the fuselage with one or more conductive connectors, wherein the antenna coupler mount is electrically coupled to the conductive layer and to the conductive material of the composite fuselage;

mounting an antenna coupler to the antenna coupler mount;

positioning a conductive spine to extend away from the composite fuselage where the conductive spine will extend along an inner surface of a structure extending away from the composite fuselage;

electrically coupling a first end of the conductive spine to the conductive layer; and electrically coupling a second end of the conductive spine to the antenna coupler.

19. The method of claim 18, wherein exposing the area of the conductive material comprises removing at least a portion of at least one of a non-conductive material and a largely non-conductive material covering the area.

20. The method of claim 18, wherein positioning the conductive spine includes mounting the conductive spine on a conductive rib that electrically couples the first end of the conductive spine to the conductive layer.

* * * * *